US012055324B2

(12) United States Patent
Takase

(10) Patent No.: US 12,055,324 B2
(45) Date of Patent: Aug. 6, 2024

(54) HEAT PUMP UNIT

(71) Applicant: TOYO ENGINEERING CORPORATION, Tokyo (JP)

(72) Inventor: Hiroshi Takase, Narashino (JP)

(73) Assignee: TOYO ENGINEERING CORPORATION, Tokyo (JP)

( * ) Notice: Subject to any disclaimer, the term of this patent is extended or adjusted under 35 U.S.C. 154(b) by 0 days.

(21) Appl. No.: 18/275,767

(22) PCT Filed: Nov. 1, 2021

(86) PCT No.: PCT/JP2021/040249
§ 371 (c)(1),
(2) Date: Aug. 3, 2023

(87) PCT Pub. No.: WO2022/168379
PCT Pub. Date: Aug. 11, 2022

(65) Prior Publication Data

US 2024/0035715 A1 Feb. 1, 2024

(30) Foreign Application Priority Data

Feb. 5, 2021 (JP) ..... 2021-017490

(51) Int. Cl.
*F25B 21/00* (2006.01)

(52) U.S. Cl.
CPC ..... *F25B 21/00* (2013.01); *F25B 2321/002* (2013.01)

(58) Field of Classification Search
CPC ..... F25B 30/00; F25B 21/04; F25B 21/00; F25B 2321/002; F28D 15/00
See application file for complete search history.

(56) References Cited

U.S. PATENT DOCUMENTS 6,467,274 B2 * 10/2002 Barclay ..... F25J 1/0225 62/607
7,104,313 B2 * 9/2006 Pokharna ..... H02K 44/04 257/E23.098

(Continued)

FOREIGN PATENT DOCUMENTS

CN 102261763 A 11/2011
JP 2003-532861 A 11/2003

(Continued)

OTHER PUBLICATIONS

International Search Report & Written Opinion issued in PCT Application No. PCT/JP2021/040249, mailed Dec. 7, 2021 (4 pages).

*Primary Examiner* — Filip Zec
(74) *Attorney, Agent, or Firm* — Foley & Lardner LLP

(57) ABSTRACT

A heat pump has an internal heat-absorbing section that receives heat and an internal heat-releasing section that releases heat. Heat is transferred between the internal heat-absorbing section and the internal heat-releasing section using a magnetic particle dispersion circulating between the internal heat-absorbing section and the internal heat-releasing section. The heat pump may include: an external heat-absorbing section in which a secondary working fluid receives heat from a heat-giving fluid; an external heat-releasing section in which the secondary working fluid releases heat to a heat-receiving fluid; and a circulation channel that allows the secondary working fluid to circulate.

5 Claims, 4 Drawing Sheets

(56) References Cited

U.S. PATENT DOCUMENTS

| | | | | |
|---|---|---|---|---|
| 7,295,435 | B2 * | 11/2007 | Ouyang | H01L 23/473 361/689 |
| 7,886,816 | B2 * | 2/2011 | Ouyang | H01L 23/34 361/689 |
| 9,976,814 | B2 * | 5/2018 | Gomez | F28F 13/06 |
| 9,983,259 | B2 * | 5/2018 | Wu | G05D 23/19 |
| 10,378,798 | B2 * | 8/2019 | Hurbi | G06F 3/011 |
| 2005/0160752 | A1 * | 7/2005 | Ghoshal | H10N 10/00 62/118 |
| 2009/0031733 | A1 * | 2/2009 | Weaver, Jr. | F25B 21/00 62/3.6 |
| 2011/0289924 | A1 * | 12/2011 | Pietsch | F28D 20/0056 165/10 |
| 2015/0033762 | A1 * | 2/2015 | Cheng | F25B 21/00 62/3.1 |
| 2019/0257555 | A1 * | 8/2019 | Rowe | F25B 21/00 |
| 2023/0392884 | A1 * | 12/2023 | Takase | F28F 23/00 |

FOREIGN PATENT DOCUMENTS

| | | | |
|---|---|---|---|
| JP | 2006-512557 | A | 4/2006 |
| JP | 2019-509461 | A | 4/2019 |

* cited by examiner

HEAT PUMP UNIT

TECHNICAL FIELD

The present invention relates to a heat pump unit with a heat pump that uses a magnetic field to transfer heat.

BACKGROUND ART

Conventionally, heat pumps have been used as a means of transferring heat from a low-temperature section to a high-temperature section. The heat pump receives heat from the low-temperature section and then raises the temperature of this heat to supply it to the high-temperature section, so that it can obtain high-temperature thermal energy from low-temperature thermal energy.

As such heat pumps, mechanical heat pumps with compressors have been commercialized. However, in heat pumps with compressors, noise caused by the compressor and complicated maintenance are recognized as problems and risks.

For example, Patent Literature 1 discloses a heat pump that uses a magnetic field to transfer heat. The heat pump disclosed in Patent Literature 1 includes particulate magnetic solids filled inside the device, and causes a magnetic field to be applied to or removing from the magnetic solids to exchange heat between the magnetic solids and a liquid working fluid flowing through a packed bed filled with the magnetic solids. This means that compared to heat pumps with compressors, noise caused by the compressor is not generated, and maintenance is easier.

CITATION LIST

Patent Literature

Patent Literature 1: JP 2019-509461 A

SUMMARY OF THE INVENTION

Technical Problem

In the heat exchange between the magnetic substances and the working fluid as described above, if the overall heat transfer coefficient depending on the condition of the heat transfer surface is U, the heat transfer area is A, and the temperature difference between the heat transfer surfaces is Δt, then the heat quantity Q to be exchanged is expressed as follows:

$$Q=U\cdot A\cdot \Delta t.$$

Therefore, to obtain a large heat quantity Q, the heat transfer area A and/or the temperature difference Δt between the heat transfer surfaces must be increased. To increase the heat transfer area A, it is necessary to increase the volume specific surface area by reducing the size of the magnetic particles. However, as disclosed in Patent Literature 1, in the heat pump that exchanges heat between the magnetic particles filled inside the device and the liquid working fluid, if the size of the magnetic particles is reduced, the pressure drop when the liquid working fluid flows through the packed bed increases. In this case, the work required to move the working fluid is increased, and the heat pump efficiency is reduced. Therefore, to obtain good efficiency, magnetic particles of relatively large size must be used. As a result, the area of contact between the magnetic substances in solid form and the liquid working fluid (i.e. the heat transfer area A) is limited.

On the other hand, to obtain a large heat quantity Q, the temperature difference Δt between the heat transfer surfaces may be increased. However, the heat pump has a problem that if the temperature difference Δt between the heat transfer surfaces is large, it is necessary to raise and lower the temperature of the working fluid extra for the temperature difference, resulting in a decrease in thermal efficiency.

Therefore, the applicant has devised a technique in which, a primary working fluid circulating between a heat-absorbing section that receives heat from an outside and a heat-releasing section that releases heat to the outside is a magnetic particle dispersion containing magnetic particles dispersed in a dispersion medium, so that the efficiency of heat exchange between the magnetic particles and the dispersion medium of the primary working fluid can be improved, enabling highly efficient heat transfer using a magnetic field. In this technique, heat pumps are arranged in multiple stages such the heat-absorbing section of the heat pump in a succeeding stage receives heat released in the heat-releasing section of the heat pump in a preceding stage, and a heat-transfer assisting section is arranged between the multiple stages of heat pumps to receive heat released in the heat-releasing section of the heat pump in the preceding stage with a secondary working fluid, and then to give the heat of the secondary working fluid to the heat-absorbing section of the heat pump in the succeeding stage. This allows heat to be transferred with a larger temperature difference.

The primary working fluid described above may be of any dispersion form, as long as the magnetic particles are dispersed in a dispersion medium. In other words, it may be a colloidal fluid or a suspension. In the following description, both cases where it is a colloidal fluid and where it is a suspension are collectively referred to as a magnetic particle dispersion.

Meanwhile, in the above configuration where the heat-transfer assisting section is arranged between the multiple stages of heat pumps to receive heat released in the heat-releasing section of the heat pump in the preceding stage with a secondary working fluid, and then to give the heat of the secondary working fluid to the heat-absorbing section of the heat pump in the succeeding stage, the temperature change obtained by the heat transfer per stage depends on the temperature change of the magnetic particle dispersion based on the magnetocaloric effect when the magnetic field is reinforced or reduced. In this case, the temperature change of the magnetic particle dispersion based on the magnetocaloric effect when the magnetic field is reinforced or reduced is generally 2 to 4° C. Therefore, many heat pumps and heat-transfer assisting sections are needed to transfer heat with a large temperature difference. In addition, a corresponding number of pumps for circulating the primary and secondary working fluids are also needed accordingly. For example, if an external heat-giving fluid is at −30° C., an external heat-receiving fluid is at 30° C., and the temperature change of the magnetic particle dispersion based on the magnetocaloric effect when the magnetic field is reinforced or reduced is 2° C. per stage, then the required number of stages is 30, and 60 pumps are needed.

Therefore, the applicant further studied the heat-transfer efficiency in the technique of transferring heat between the external heat-giving fluid and the external heat-receiving fluid through heat exchange between the primary and secondary working fluids.

It is an object of the present invention to provide a heat pump unit that can further improve the heat-transfer efficiency in the technique of transferring heat between an external heat-giving fluid and an external heat-receiving fluid through heat exchange between a primary working fluid and a secondary heat-receiving fluid.

Solution to Problem

To achieve the above object, the present invention is a heat pump unit for transferring heat between an external heat-giving fluid and an external heat-receiving fluid using a magnetic particle dispersion containing magnetic particles dispersed in a dispersion medium as a primary working fluid, including:

- a heat pump having an internal heat-absorbing section that receives heat and an internal heat-releasing section that releases heat, for transferring heat between the internal heat-absorbing section and the internal heat-releasing section by reinforcing and reducing a magnetic field applied to the primary working fluid circulating between the internal heat-absorbing section and the internal heat-releasing section;
- an external heat-absorbing section in which a secondary working fluid receives heat from the external heat-giving fluid;
- an external heat-releasing section in which the secondary working fluid releases heat to the external heat-receiving fluid; and
- a circulation channel that allows the secondary working fluid to circulate between the external heat-absorbing section, the heat pump, and the internal heat-releasing section, such that the secondary working fluid receives heat from the external heat-giving fluid in the external heat-absorbing section, then receives heat released from the primary working fluid in the internal heat-releasing section of the heat pump, then releases heat to the external heat-receiving fluid in the external heat-releasing section, then releases heat to the primary working fluid in the internal heat-absorbing section of the heat pump, and then receives heat again from the external heat-giving fluid in the external heat-absorbing section.

In the present invention configured as described above, the secondary working fluid, circulating between the external heat-absorbing section, the heat pump, and the external heat-releasing section through the circulation channel, receives heat from the external heat-giving fluid in the external heat-absorbing section, then receives heat released from the primary working fluid in the internal heat-releasing section of the heat pump, then releases heat to the external heat-receiving fluid in the external heat-releasing section, then releases heat to the primary working fluid in the internal heat-absorbing section of the heat pump, and then receives heat again from the external heat-giving fluid in the external heat-absorbing section. Therefore, the temperature difference that can be achieved in thermal energy pumping by the heat pump unit, i.e., the temperature difference that can be set for the temperature conditions of the external heat-giving fluid and the external heat-receiving fluid, depends on the temperature change in the heat exchange between the primary working fluid and the secondary working fluid. Here, the temperature change in the heat exchange between the primary working fluid and the secondary working fluid is generally larger than the temperature change of the magnetic particle dispersion based on the magnetocaloric effect when the magnetic field is reinforced or reduced. Accordingly, thermal energy can be transferred, with a large temperature difference, between the external heat-giving fluid and the external heat-receiving fluid, further improving the efficiency of heat transfer between the external heat-giving fluid and the external heat-receiving fluid.

Further, in the heat pump unit wherein the heat pump is arranged in multiple stages between the external heat-absorbing section and the external heat-releasing section in a flow direction of the secondary working fluid in the circulation channel, thermal energy can be transferred with a large temperature difference for each stage, reducing the required number of stages.

Further, if a source of the magnetic field is a permanent magnet, the magnetic field is generated without the need for a power source.

Further, in each of the multiple stages of heat pumps, if a magnetic material for the primary working fluid is individually selected depending on temperatures of heat to be absorbed in the internal heat-absorbing section of and heat to be released in the internal heat-releasing section of each heat pump, the overall thermal efficiency is further improved.

Further, if the secondary working fluid flows through a common channel with the primary working fluid at a region where heat exchange with the primary working fluid occurs, and if one of the primary working fluid and the secondary working fluid that flow through the common channel is hydrophilic and another is hydrophobic, the heat transfer resistance between the primary working fluid and the secondary working fluid is reduced to allow more efficient heat exchange, yet the primary working fluid and the secondary working fluid can be easily separated from each other after the heat exchange between them.

Advantageous Effects of Invention

According to the present invention, the secondary working fluid, circulating between the external heat-absorbing section, the heat pump, and the external heat-releasing section through the circulation channel, receives heat from the external heat-giving fluid in the external heat-absorbing section, then receives heat released from the primary working fluid in the internal heat-releasing section of the heat pump, then releases heat to the external heat-receiving fluid in the external heat-releasing section, then releases heat to the primary working fluid in the internal heat-absorbing section of the heat pump, and then receives heat again from the external heat-giving fluid in the external heat-absorbing section, whereby the temperature difference that can be achieved in thermal energy pumping by the heat pump unit, i.e., the temperature difference between the external heat-giving fluid and the external heat-receiving fluid, depends on the temperature change in the heat exchange between the primary working fluid and the secondary working fluid. Thus, thermal energy can be transferred, with a large temperature difference, between the external heat-giving fluid and the external heat-receiving fluid, further improving the heat-transfer efficiency in the technique of transferring heat between the external heat-giving fluid and the external heat-receiving fluid through heat exchange between the primary working fluid and the secondary working fluid.

Further, in the heat pump unit wherein the heat pump is arranged in multiple stages between the external heat-absorbing section and the external heat-releasing section in a flow direction of the secondary working fluid in the circulation channel, thermal energy can be transferred with a large temperature difference for each stage, reducing the required number of stages.

Further, in the heat pump wherein the source of the magnetic field is a permanent magnet, the magnetic field can be generated without the need for a power source.

Further, in the heat pump unit wherein in each of the multiple stages of heat pumps, if a magnetic material for the primary working fluid is individually selected depending on temperatures of heat to be absorbed in the internal heat-absorbing section of and heat to be released in the internal heat-releasing section of each heat pump, the overall thermal efficiency can be further improved.

In the heat pump unit wherein the secondary working fluid flows through a common channel with the primary working fluid at a region where heat exchange with the primary working fluid occurs, and wherein one of the primary working fluid and the secondary working fluid that flow through the common channel is hydrophilic and another is hydrophobic, the heat transfer resistance between the primary working fluid and the secondary working fluid is reduced to allow more efficient heat exchange, yet the primary working fluid and the secondary working fluid can be easily separated from each other after the heat exchange between them.

DESCRIPTION OF EMBODIMENTS

An embodiment of the present invention will be described below with reference to the drawings.

Figure 1:
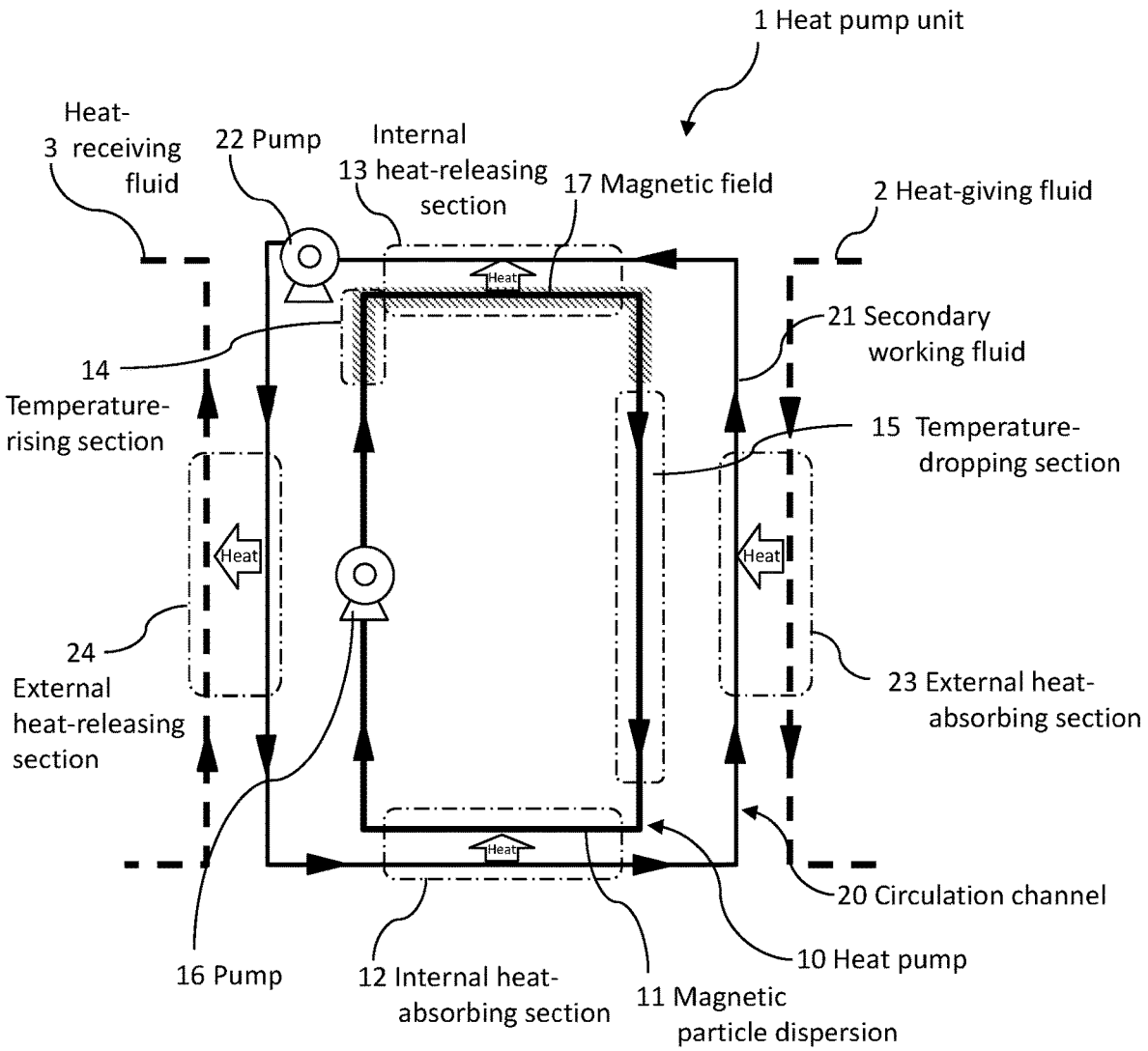
FIG. 1 shows a heat pump unit according to an embodiment of the present invention.

FIG. 1 shows a heat pump unit according to an embodiment of the present invention.

As shown in FIG. 1, the heat pump unit according to this embodiment receives heat from heat-giving fluid 2 and releases heat to heat-receiving fluid 3 so that heat is transferred between heat-giving fluid 2 and heat-receiving fluid 3. The heat pump unit according to this embodiment includes heat pump 10, external heat-absorbing section 23, external heat-releasing section 24, and circulation channel 20.

Heat pump 10 is provided, on a channel through which magnetic particle dispersion 11 as a primary working fluid flows, with internal heat-absorbing section 12, temperature-rising section 14, internal heat-releasing section 13, temperature-dropping section 15, and pump 16.

Internal heat-absorbing section 12 is located close to circulation channel 20. Internal heat-absorbing section 12 causes magnetic particle dispersion 11 to receive heat from secondary working fluid 21 that is guided through circulation channel 20.

Temperature-rising section 14 is located downstream of internal heat-absorbing section 12 in the flow direction of magnetic particle dispersion 11. Temperature-rising section 14 causes the temperature of magnetic particle dispersion 11 to rise by reinforcing magnetic field 17 with respect to magnetic particle dispersion 11 that has received heat in internal heat-absorbing section 12.

Internal heat-releasing section 13 is located close to circulation channel 20 and downstream of temperature-rising section 14 in the flow direction of magnetic particle dispersion 11. Internal heat-releasing section 13 causes magnetic particle dispersion 11 to release heat to secondary working fluid 21 that is guided through circulation channel 20.

Temperature-dropping section 15 is located downstream of internal heat-releasing section 13 in the flow direction of magnetic particle dispersion 11. Temperature-dropping section 15 causes the temperature of magnetic particle dispersion 11 to drop by removing or reducing magnetic field 17 applied to magnetic particle dispersion 11 that has released heat in internal heat-releasing section 13.

Pump 16 is located between internal heat-absorbing section 12 and temperature-rising section 14 in the channel for magnetic particle dispersion 11. Pump 16 circulates magnetic particle dispersion 11 through the channel. The location of pump 16 is not limited to between internal heat-absorbing section 12 and temperature-rising section 14, as long as it can circulate magnetic particle dispersion 11 through the channel.

External heat-absorbing section 23 is located downstream of internal heat-absorbing section 12 and upstream of internal heat-releasing section 13 in the flow direction of secondary working fluid 21. External heat-absorbing section 23 causes secondary working fluid 21 that is guided through circulation channel 20 to receive heat from heat-giving fluid 2.

External heat-releasing section 24 is located downstream of internal heat-releasing section 13 and upstream of internal heat-absorbing section 12 in the flow direction of secondary working fluid 21. External heat-releasing section 24 causes secondary working fluid 21 that is guided through circulation channel 20 to release heat to heat-receiving fluid 3.

Circulation channel 20 is designed to allow secondary working fluid 21 to circulate between external heat-absorbing section 23, heat pump 10, and external heat-releasing section 24. Circulation channel 20 is provided with pump 22 for circulating secondary working fluid 21.

The operation of heat pump unit 1 shown in FIG. 1 will be described below.

Figure 2:
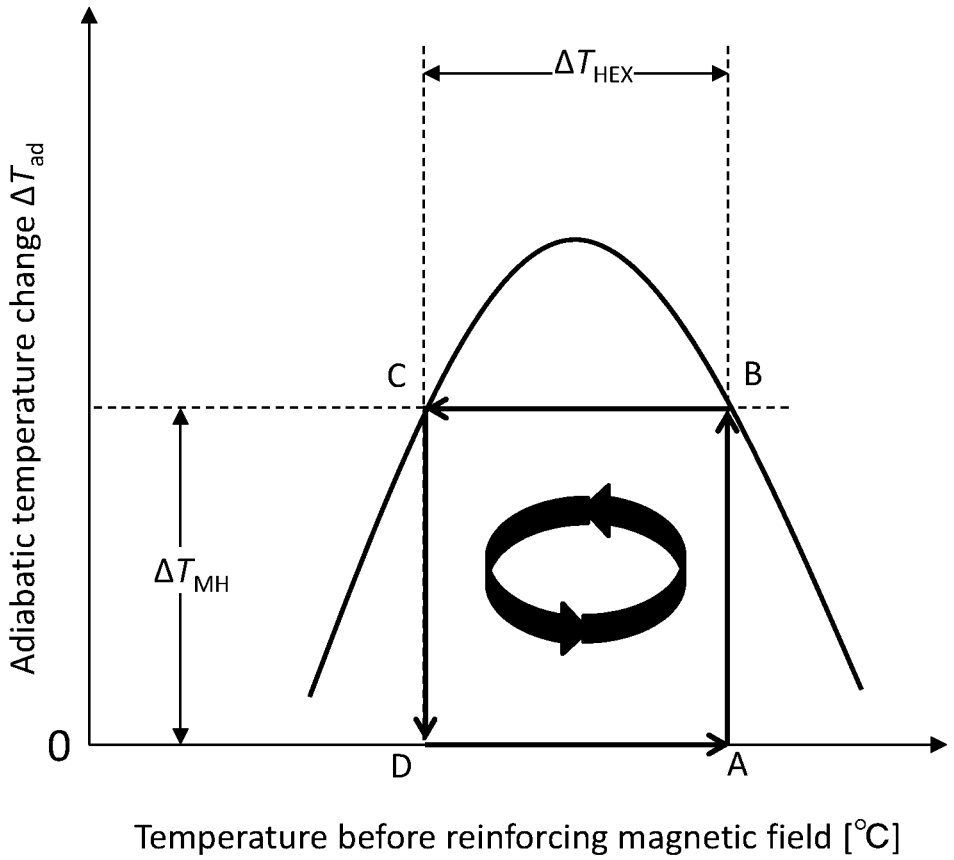
FIG. 2 shows the temperature dependence of the adiabatic temperature change of a magnetic particle dispersion flowing through a channel of a heat pump shown in FIG. 1.

FIG. 2 shows the temperature dependence of the adiabatic temperature change of magnetic particle dispersion 11 flowing through the channel of heat pump 10 shown in FIG. 1.

In heat pump unit 1 shown in FIG. 1, secondary working fluid 21 first receives heat from heat-giving fluid 2 in external heat-absorbing section 23, and then circulates through circulation channel 20 by the action of pump 22 to be supplied to internal heat-releasing section 13 of heat pump 10.

On the other hand, in temperature-rising section 14 of heat pump 10, magnetic field 17 applied to magnetic particle dispersion 11 is reinforced in an adiabatic environment. This causes the magnetic moments of magnetic particles contained in magnetic particle dispersion 11 to change, whereby the characteristic point in FIG. 2 moves from point A to point B. In this case, since the magnetic moments are changed in an adiabatic environment, the temperature of magnetic particle dispersion 11 rises.

Magnetic particle dispersion 11 whose temperature has been raised in temperature-rising section 14, flows through the channel by the action of pump 16 to be supplied to internal heat-releasing section 13. In internal heat-releasing section 13, magnetic field 17 applied to magnetic particle dispersion 11 that has passed through temperature-rising section 14 is kept reinforced. Then, secondary working fluid 21 that is guided through circulation channel 20 receives heat from magnetic particle dispersion 11. This causes the temperature of magnetic particle dispersion 11 to drop with heat release, whereby the characteristic point in FIG. 2 moves from point B to point C. In this case, secondary working fluid 21 circulating through circulation channel 20 receives the heat released from magnetic particle dispersion 11, i.e., the heat due to the temperature change from point B to point C in FIG. 2. Therefore, under appropriate flow conditions, the difference between the temperatures of secondary working fluid 21 before and after receiving the heat released from magnetic particle dispersion 11 in internal heat-releasing section 13 can be the temperature change $\Delta T_{HEX}$ of magnetic particle dispersion 11 in the heat exchange between magnetic particle dispersion 11 and secondary working fluid 21.

Magnetic particle dispersion 11 that has released heat to secondary working fluid 21 in internal heat-releasing section 13, flows through the channel by the action of pump 16 and to be supplied to temperature-dropping section 15. In temperature-dropping section 15, magnetic field 17 applied to magnetic particle dispersion 11, that has been reinforced when having passed through internal heat-releasing section 13, is reduced. This causes the magnetic moments of magnetic particles 11*b* to change, whereby the characteristic point in FIG. 2 moves from point C to point D. In this case, since the magnetic moments are changed in an adiabatic environment, the temperature of magnetic particle dispersion 11 drops. As a result, the temperature of magnetic particle dispersion 11 supplied to internal heat-absorbing section 12 after passage through temperature-dropping section 15 is lower than the temperature of magnetic particle dispersion 11 supplied to temperature-rising section 14 after passage through internal heat-absorbing section 12.

On the other hand, secondary working fluid 21 that has received the heat released from magnetic particle dispersion 11 in internal heat-releasing section 13, circulates through circulation channel 20 by the action of pump 22 to be supplied to external heat-releasing section 24, and then releases heat to heat-receiving fluid 3. In this case, the temperature of the heat released from secondary working fluid 21 to heat-receiving fluid 3 is higher than the temperature of secondary working fluid 21 before receiving the heat released from magnetic particle dispersion 11 in internal heat-releasing section 13, by the temperature change $\Delta T_{HEX}$ of magnetic particle dispersion 11 in the heat exchange between magnetic particle dispersion 11 and secondary working fluid 21, as described above. The temperature difference that can be employed as the temperature change $\Delta T_{HEX}$ of magnetic particle dispersion 11 in the heat exchange between magnetic particle dispersion 11 and secondary working fluid 21 is generally larger than the temperature difference that can be employed as the temperature change $\Delta T_{MH}$ of magnetic particle dispersion 11 based on the magnetocaloric effect when the magnetic field is reinforced or reduced. Therefore, thermal energy can be transferred with a large temperature difference, between heat-giving fluid 2 and heat-receiving fluid 3, further improving the efficiency of heat transfer between heat-giving fluid 2 and heat-receiving fluid 3.

Secondary working fluid 21 that has released heat to heat-receiving fluid 3, circulates through circulation channel 20 by the action of pump 22 to be supplied to internal heat-absorbing section 12 of heat pump 10. On the other hand, magnetic particle dispersion 11 whose temperature has dropped in temperature-dropping section flows through the channel by the action of pump 16 to be supplied to internal heat-absorbing section 12. In internal heat-absorbing section 12, heat is released from secondary working fluid 21 to magnetic particle dispersion 11 while a magnetic field applied to magnetic particle dispersion 11 is not reinforced. This causes the temperature of magnetic particle dispersion 11 to rise, whereby the characteristic point in FIG. 2 moves from point D to point A.

Secondary working fluid 21 that has released heat to magnetic particle dispersion 11 in internal heat-absorbing section 12, circulates through circulation channel 20 by the action of pump 22 to be supplied again to external heat-absorbing section 23, and then receives heat from heat-giving fluid 2.

A permanent magnet or an electromagnet is a possible source of magnetic field 17, and in heat pump unit 1 shown in FIG. 1, a permanent magnet is more preferably used in view of the fact that no power source is required.

Thus, in this embodiment, secondary working fluid 21, circulating between external heat-absorbing section 23, heat pump 10, and external heat-releasing section 24 through circulation channel 20, receives heat from heat-giving fluid 2 in external heat-absorbing section 23, then receives heat released from magnetic particle dispersion 11 in internal heat-releasing section 13 of heat pump 10, then releases heat to heat-receiving fluid 3 in external heat-releasing section 24, then releases heat to magnetic particle dispersion 11 in internal heat-absorbing section 12 of heat pump 10, and then receives heat again from heat-giving fluid 2 in external heat-absorbing section 23. Therefore, the temperature difference that can be achieved in thermal energy pumping by the heat pump unit, i.e., the temperature difference between the external heat-giving fluid and the external heat-receiving fluid, is the temperature change $\Delta T_{HEX}$ of magnetic particle dispersion 11 in the heat exchange between magnetic particle dispersion 11 and secondary working fluid 21. As a result, thermal energy can be transferred, with a large temperature difference, between heat-giving fluid 2 and heat-receiving fluid 3, further improving the heat-transfer efficiency in the technique of transferring heat between heat-giving fluid 2 and heat-receiving fluid 3 through heat exchange between magnetic particle dispersion 11 and secondary working fluid 21.

In heat pump unit 1 configured as shown in FIG. 1, the larger the temperature change $\Delta T_{HEX}$, as shown in FIG. 2, in the heat exchange with secondary working fluid 21, the larger the temperature difference between heat-giving fluid 2 and heat-receiving fluid 3 when thermal energy is transferred between them. In other words, the temperature change $\Delta T_{MH}$ of the magnetic particle dispersion based on the magnetocaloric effect when the magnetic field is reinforced or reduced is preferably as small as possible.

If the specific heat of secondary working fluid 21 is $c_s$ and the flow rate of secondary working fluid 21 is F, then the amount of heat transfer Q required for heat pump unit 1 is obtained as follows:

$$Q=\Delta T_{MH}\times c_s\times F.$$

In other words, when the flow rate F of secondary working fluid 21 is set as high as possible to obtain the required amount of heat transfer Q, $\Delta T_{MH}$ can be as small as possible. Therefore, maximization of the flow rate F of secondary working fluid 21 allows for highly efficient heat transfer between heat-giving fluid 2 and heat-receiving fluid 3.

In heat pump unit 1 shown in FIG. 1 where secondary working fluid 21 receives heat released from magnetic particle dispersion 11 in internal heat-releasing section 13 and magnetic particle dispersion 11 receives heat released from secondary working fluid 21 in internal heat-absorbing section 12, heat is transferred between magnetic particle dispersion 11 flowing through the channel of heat pump 10 and secondary working fluid 21 circulating through circulation channel 20. In this case, if the heat transfer between magnetic particle dispersion 11 and secondary working fluid 21 occurs not through direct contact with each other, but through the walls of the channels through which they flow, there will be a loss of heat transfer through the walls of the channels. Therefore, the temperature of magnetic particle dispersion 11 must be raised or lowered extra for the temperature difference caused by the loss. The larger this temperature difference, the lower the heat-exchange efficiency of the heat pump unit. On the other hand, to transfer heat between magnetic particle dispersion 11 and secondary working fluid 21 through the walls of the channels without reducing the heat-exchange efficiency, the wall materials of the channels must be expensive. In other words, an attempt to transfer heat without bringing magnetic particle dispersion 11 into contact with secondary working fluid 21 involves difficulties in terms of heat-exchange efficiency and economy.

A configuration will be described below in which the economy is not compromised and the heat-exchange efficiency is reduced when heat is transferred between magnetic particle dispersion 11 flowing through the channel of heat pump 10 and secondary working fluid 21 circulating through circulation channel 20 as shown in FIG. 1.

Figure 3:
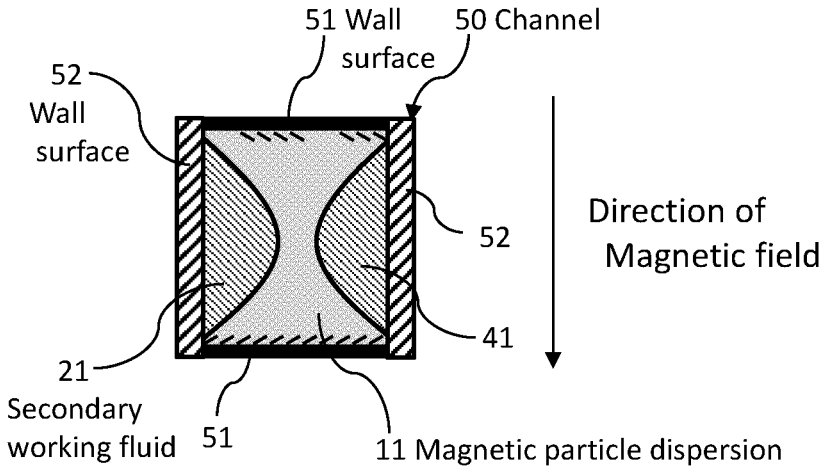
FIG. 3 is a cross-sectional view of a channel at an internal heat-absorbing section and an internal heat-releasing section, for flow of the magnetic particle dispersion that flows through the channel of the heat pump and of the secondary working fluid that circulates through a circulation channel, in the heat pump unit shown in FIG. 1.

FIG. 3 is a cross-sectional view of a channel at internal heat-absorbing section 12 and internal heat-releasing section 13, for flow of magnetic particle dispersion 11 that flows through the channel of heat pump 10 and of secondary working fluid 21 that circulates through circulation channel 20, in heat pump unit 1 shown in FIG. 1.

As shown in FIG. 3, magnetic particle dispersion 11 and secondary working fluid 21 are configured to flow through common channel 50 with each other at the region where heat exchange occurs between magnetic particle dispersion 11 and secondary working fluid 21. In this case, if the dispersion medium of magnetic particle dispersion 11 is hydrophilic, then a hydrophobic fluid is used as secondary working fluid 21, or if the dispersion medium of magnetic particle dispersion 11 is hydrophobic, then a hydrophilic fluid is used as secondary working fluid 21. In other words, magnetic particle dispersion 11 and secondary working fluid 21 are configured such that one of them is hydrophilic and the other is hydrophobic.

Further, for example, in the channel with a square cross section, of two sets of wall surfaces 51, 52, each set facing each other, one set of wall surfaces 51 is processed to produce a magnetic field and/or to have an affinity for the dispersion medium of the magnetic particle dispersion, while the other set of wall surfaces 52 is processed to have an affinity for secondary working fluid 21. When magnetic particle dispersion 11 and secondary working fluid 21 flow through channel 50 processed as described above while a magnetic field is applied in a direction where wall surfaces 51 face each other, magnetic particle dispersion 11 and secondary working fluid 21 flows along wall surfaces 51 and wall surfaces 52, respectively, with being separated from each other, due to the effects of both the magnetic force due to the magnetic field and the surface tension of the fluid, as shown in FIG. 3. In this case, to allow magnetic particle dispersion 11 and secondary working fluid 21 to flow along wall surfaces 51 and wall surfaces 52, respectively, with being separated from each other, the size of the channel must be small enough so that the magnetic force due to the magnetic field and the surface tension of the fluid are dominant over the other forces.

Since magnetic particle dispersion 11 and secondary working fluid 21 are kept separated from each other in the channel, magnetic particle dispersion 11 and secondary working fluid 21 can be easily retrieved with being separated from each other after the heat exchange between them, as a result of retrieving magnetic particle dispersion 11 from wall surfaces 51 with high affinity for it and retrieving secondary working fluid 21 from wall surfaces 52 with high affinity for it.

As described above, since magnetic particle dispersion 11 and secondary working fluid 21 are configured such that one of them is hydrophilic and the other is hydrophobic, magnetic particle dispersion 11 and secondary working fluid 21 can be brought into direct contact with each other inside one channel 50 to perform heat exchange between them. This reduces the heat transfer resistance between magnetic particle dispersion 11 and secondary working fluid 21, allowing efficient heat exchange with a temperature difference as close to "0" as possible. Further, since magnetic particle dispersion 11 and secondary working fluid 21 are configured such that one of them is hydrophilic and the other is hydrophobic, magnetic particle dispersion 11 and secondary working fluid 21 can be easily retrieved with being separated from each other after the heat exchange between them. In addition, heat exchange between magnetic particle dispersion 11 and secondary working fluid 21 is performed as described above, which can realize a configuration that reduces as much as possible the loss associated with the temperature difference required for the heat exchange between magnetic particle dispersion 11 and secondary working fluid 21.

A configuration will be described below in which thermal energy is transferred with an even larger temperature difference in a heat pump unit based on the configuration described above.

Figure 4:
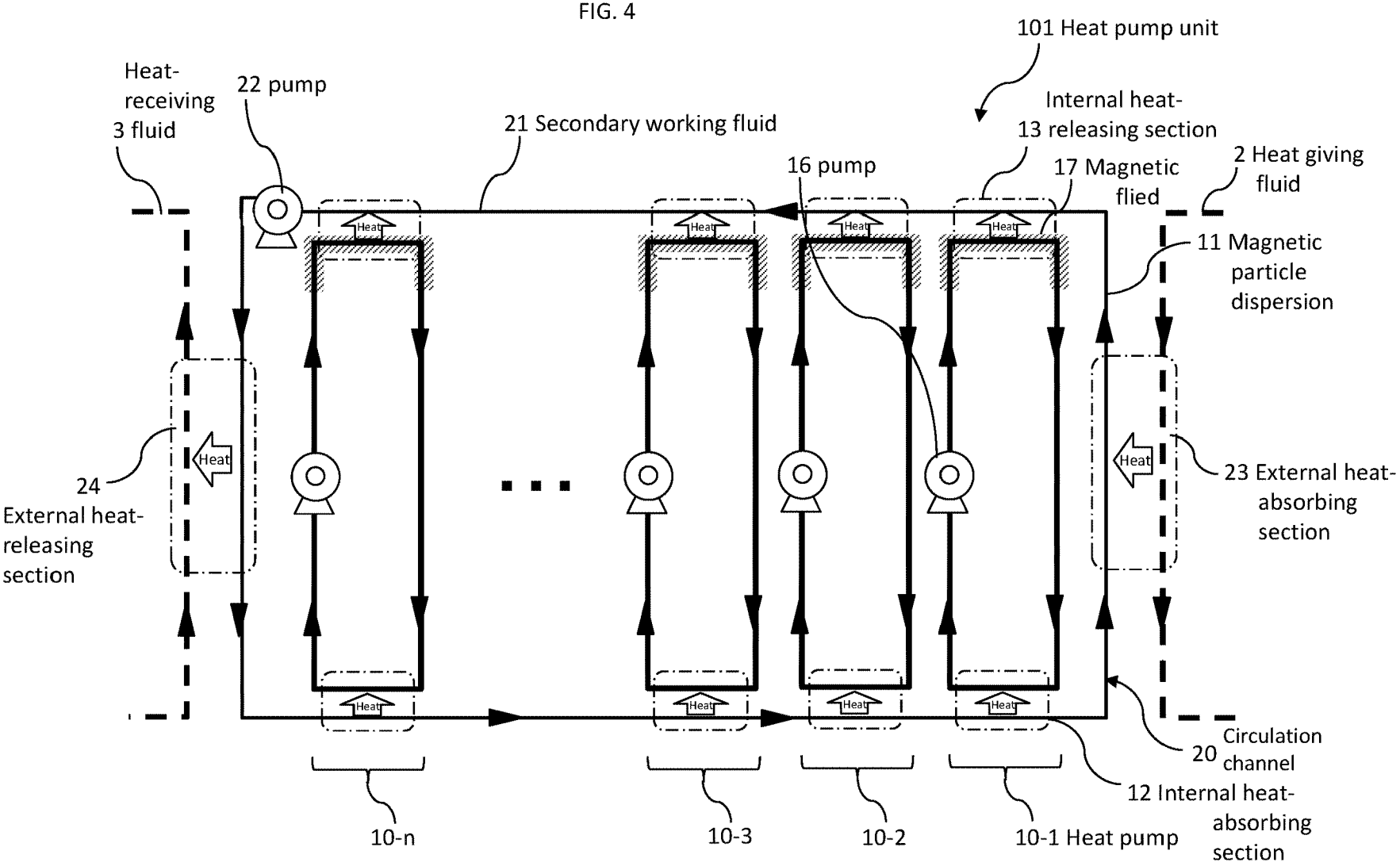
FIG. 4 shows an exemplary heat pump unit configured to, based on the configuration shown in FIG. 1, transfer thermal energy with an even larger temperature difference.

FIG. 4 shows an exemplary heat pump unit configured to, based on the configuration shown in FIG. 1, transfer thermal energy with an even larger temperature difference.

As shown in FIG. 4, this exemplary configuration is heat pump unit 101 that is different from the one shown in FIG. 1 in that multiple stages of heat pumps 10-1 to **10-*n* are arranged between external heat-absorbing section 23 and external heat-releasing section 24 in the flow direction of secondary working fluid 21 circulating through circulation channel 20**.

In heat pump unit 101 shown in FIG. 4, secondary working fluid 21 circulating through circulation channel 20 receives heat from heat-giving fluid 2 in external heat-absorbing section 23, and then receives heat released from magnetic particle dispersion in internal heat-releasing section 13 of respective heat pumps 10-1 to **10-*n*, whereby secondary working fluid 21 rises in temperature gradually. For example, suppose that it receives heat of −30° C. from heat-giving fluid 2 and the temperature change $\Delta T_{HEX}$ in the heat exchange between magnetic particle dispersion 11 and secondary working fluid 21 is 6° C. In that case, secondary working fluid 21 circulating through circulation channel 20 receives heat from heat-giving fluid 2 of −30° C. in external heat-absorbing section 23 to reach a temperature of −28° C., and then receives heat from magnetic particle dispersion 11 in internal heat-releasing section 13 of heat pump 10-1 to rise in temperature by 6° C. to −22° C. Next, it receives heat released from magnetic particle dispersion 11 in internal heat-releasing section 13 of heat pump 10-2 to rise in temperature by 6° C. to −16° C. Thus, it finally receives heat released from magnetic particle dispersion 11 at internal heat-releasing section 13 of heat pump 10-*n* to rise in temperature to (−28+6×n)° C. This heat of (−28+6×n)° C. is then released from secondary working fluid 21 to heat-receiving fluid 3 in external heat-releasing section 24**.

After the heat is released from secondary working fluid 21 to heat-receiving fluid 3 in external heat-releasing section 24, secondary working fluid 21 releases heat to magnetic particle dispersion 11 in internal heat-absorbing section 12 of respective heat pumps **10-*n* to 10-1 to drop in temperature by 6° C., and then receives heat again from heat-giving fluid 2 in external heat-absorbing section 23**.

In this case, if heat-giving fluid 2 is at −30° C. and heat-receiving fluid 3 is at 30° C., then the required number of stages is 60÷6=10. Therefore, the required number of pumps is 11, which is 10, i.e. the number of heat pumps, plus 1, i.e. the number of circulation channel 20. That means that, in heat pump unit 101 shown in FIG. 4, (Required number of heat pump stages Ns)=(Temperature difference between heat-giving fluid 2 and heat-receiving fluid 3)/(Temperature change $\Delta T_{HEX}$ in heat exchange between magnetic particle dispersion 11 and secondary working fluid 21), and (Required number of pumps Np)=(Temperature difference between heat giving-fluid 2 and heat-receiving fluid 3)/(Temperature change $\Delta T_{HEX}$ in heat exchange between magnetic particle dispersion 11 and secondary working fluid 21)+1.

How much and in which temperature range the magnetocaloric effect causes heat release or heat absorption to occur is specific to each type of magnetic material for magnetic particle dispersion 11, and if they are made of an alloy, it varies in a complex manner depending on the composition of the alloy. For that reason, in the heat pump using the magnetocaloric effect, suitable magnetic materials generally depend on the temperature level to be applied.

Therefore, it is possible that as the magnetic material for magnetic particle dispersion 11 flowing through the respective channels of heat pumps 10-1 to **10-*n* that constitute heat pump unit 101 shown in FIG. 4, a magnetic material that releases/absorbs large amounts of heat due to the magnetocaloric effect may be individually selected depending on the temperatures of heat to be received in internal heat-absorbing section 12 and heat to be released in internal heat-releasing section 13 of heat pumps 10-1 to 10-*n***.

Figure 5:
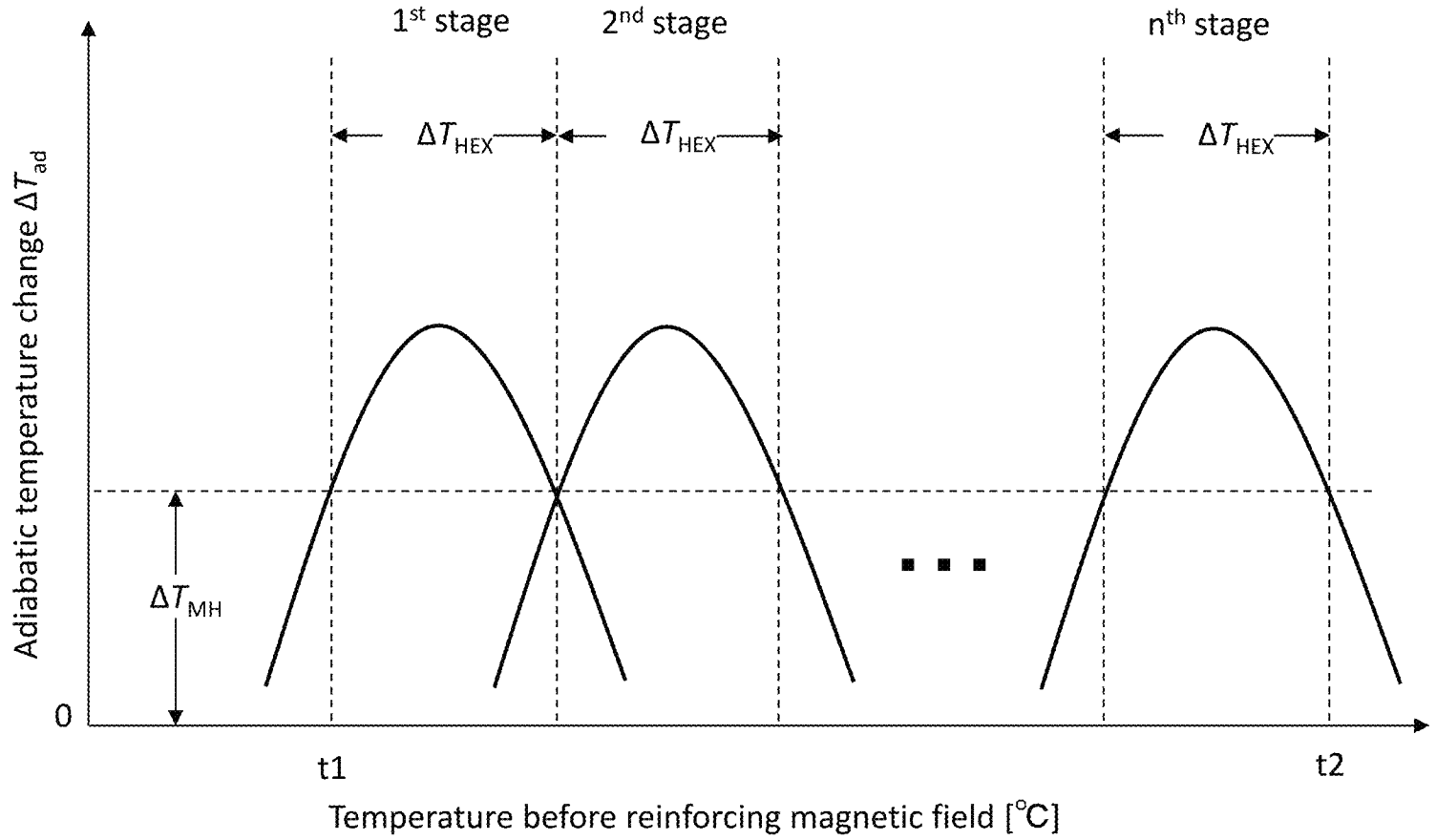
FIG. 5 illustrates how to select the magnetic material for the magnetic particle dispersion that flows through the respective channels of the heat pumps that constitute the heat pump unit shown in FIG. 4.

FIG. 5 illustrates how to select the magnetic material for magnetic particle dispersion 11 flowing through the respective channels of heat pumps 10-1 to **10-*n* that constitute heat pump unit 101 shown in FIG. 4**.

As described above, in heat pump unit 101 shown in FIG. 4, heat is transferred between heat-giving fluid 2 and heat-receiving fluid 3 through heat exchange between magnetic particle dispersion 11 flowing through the respective channels of multiple stages of heat pumps 10-1 to **10-*n* and secondary working fluid 21 circulating through circulation channel 20. Therefore, as described above, after setting $\Delta T_{MH}$ by setting the flow rate F of secondary working fluid 21 as high as possible, $\Delta T_{HEX}$ and the magnetic material for magnetic particle dispersion 11 flowing through the channel of the heat pump in each stage are selected such that, in the temperature dependence of the adiabatic temperature change of magnetic particle dispersion 11 flowing through the respective channels of multiple stages of heat pumps 10-1 to 10-*n* as shown in FIG. 5, the low-temperature endpoint is the high-temperature endpoint of magnetic particle dispersion 11 flowing through the channel of the heat pump in the preceding stage, and the high-temperature endpoint is the low-temperature endpoint of magnetic particle dispersion 11 flowing through the channel of the heat pump in the succeeding stage. Specifically, the magnetic material for magnetic particle dispersion 11 flowing through the channel of the first-stage heat pump is selected, based on the evaluation criterion of maximizing $\Delta T_{HEX}$ when the temperature of heat-giving fluid 2 after cooling is the low-temperature endpoint, under $\Delta T_{MH}$ that is set in the manner described above. For the second and subsequent stages, the magnetic material is selected based on the evaluation criterion of maximizing the $\Delta T_{HEX}$ when the high-temperature endpoint of $\Delta T_{HEX}$ in the preceding stage is the low-temperature endpoint. This is repeated so that a stage where the high-temperature endpoint of $\Delta T_{HEX}$ is equal to or higher than the temperature of heat-receiving fluid 3 before heating is the final stage. As shown in FIG. 5**, when $\Delta T_{MH}$ is as small as possible, $\Delta T_{HEX}$ can be large, resulting in a heat pump unit with fewer stages.

Thus, in each of the multiple stages of heat pumps, if the magnetic material for magnetic particle dispersion 11 is individually selected depending on the temperatures of heat to be received in internal heat-absorbing section 12 and heat to be released in internal heat-releasing section 13 of each heat pump, the overall thermal efficiency can be improved.

REFERENCE SIGNS LIST

1 Heat pump unit
2 Heat-giving fluid
3 Heat-receiving fluid
10, 10-1 to **10-*n*** Heat pump
11 Magnetic particle dispersion
12 Internal heat-absorbing section
13 Internal heat-releasing section
14 Temperature-rising section
15 Temperature-dropping section
16, 22 Pump
17 Magnetic field
20 Circulation channel
21 Secondary working fluid
23 External heat-absorbing section
24 External heat-releasing section
50 Channel
51, 52 Wall surface

The invention claimed is:

1. A heat pump unit for transferring heat between an external heat-giving fluid and an external heat-receiving fluid using a magnetic particle dispersion containing magnetic particles dispersed in a dispersion medium as a primary working fluid, comprising:

a heat pump having an internal heat-absorbing section that receives heat at relatively low temperatures and an internal heat-releasing section that releases heat at relatively high temperatures, for transferring heat between the internal heat-absorbing section and the internal heat-releasing section by reinforcing and reducing a magnetic field applied to the primary working fluid circulating between the internal heat-absorbing section and the internal heat-releasing section;

an external heat-absorbing section in which a secondary working fluid receives heat from the external heat-giving fluid;

an external heat-releasing section in which the secondary working fluid releases heat to the external heat-receiving fluid; and a circulation channel that allows the secondary working fluid to circulate between the external heat-absorbing section, the heat pump, and the external heat-releasing section, such that the secondary working fluid receives heat from the external heat-giving fluid in the external heat-absorbing section, then receives heat released from the primary working fluid in the internal heat-releasing section of the heat pump, then releases heat to the external heat-receiving fluid in the external heat-releasing section, then releases heat to the primary working fluid in the internal heat-absorbing section of the heat pump, and then receives heat again from the external heat-giving fluid in the external heat-absorbing section.

2. The heat pump unit according to claim 1, wherein the heat pump is arranged in multiple stages between the external heat-absorbing section and the external heat-releasing section in a flow direction of the secondary working fluid in the circulation channel.

3. The heat pump unit according to claim 2, wherein in each of the multiple stages of heat pumps, a magnetic material for the primary working fluid is individually selected depending on temperatures of heat to be absorbed in the internal heat-absorbing section of and heat to be released in the internal heat-releasing section of each heat pump.

4. The heat pump unit according to claim 1, wherein a source of the magnetic field is a permanent magnet.

5. The heat pump unit according to claim 1, wherein the secondary working fluid flows through a common channel with the primary working fluid at a region where heat exchange with the primary working fluid occurs, and wherein one of the primary working fluid and the secondary working fluid that flow through the common channel is hydrophilic and another is hydrophobic.

* * * * *